US010522086B2

(12) United States Patent
Wang et al.

(10) Patent No.: US 10,522,086 B2
(45) Date of Patent: Dec. 31, 2019

(54) AMOLED SCAN DRIVING CIRCUIT AND METHOD, LIQUID CRYSTAL DISPLAY PANEL AND DEVICE

(71) Applicant: Shenzhen China Star Optoelectronics Technology Co., Ltd., Shenzhen (CN)

(72) Inventors: Zhenling Wang, Shenzhen (CN); Tai Jiun Hwang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/328,514

(22) PCT Filed: Jan. 9, 2017

(86) PCT No.: PCT/CN2017/070643
§ 371 (c)(1),
(2) Date: Jun. 7, 2017

(87) PCT Pub. No.: WO2018/036088
PCT Pub. Date: Mar. 1, 2018

(65) Prior Publication Data

US 2018/0197478 A1 Jul. 12, 2018

(30) Foreign Application Priority Data

Aug. 24, 2016 (CN) ..... 2016 1 0714844

(51) Int. Cl.
*G09G 3/3266* (2016.01)
*G09G 3/3233* (2016.01)
*G09G 3/3225* (2016.01)

(52) U.S. Cl.
CPC ..... *G09G 3/3266* (2013.01); *G09G 3/3225* (2013.01); *G09G 3/3233* (2013.01);
(Continued)

(58) Field of Classification Search
CPC ... G09G 3/3266; G09G 3/3225; G09G 3/3233
See application file for complete search history.

(56) References Cited

U.S. PATENT DOCUMENTS 7,471,278 B2 12/2008 Ito
8,125,422 B2 2/2012 Choi
(Continued)

FOREIGN PATENT DOCUMENTS

CN 1606060 A 4/2005
CN 1758303 A 4/2006
(Continued)

OTHER PUBLICATIONS

International Search Report and Written Opinion issued in related PCT/CN2017/070643 dated May 11, 2017.
(Continued)

*Primary Examiner* — Vijay Shankar
*Assistant Examiner* — Cory A Almeida
(74) *Attorney, Agent, or Firm* — Andrew C. Cheng

(57) ABSTRACT

Provided is an AMOLED scan driving circuit and method as well as a liquid crystal display panel and device. The circuit comprises shift register units and logical units. Selectors are arranged between adjacent shift register units and between adjacent logical units, and different scan driving signals are output when the selectors are controlled by selection control signals, the shift register units are controlled by clock signals and start pulse signals, and the logical units are controlled by logic control signals.

17 Claims, 5 Drawing Sheets

(52) U.S. Cl.
CPC ..... *G09G 2300/0819* (2013.01); *G09G 2300/0842* (2013.01); *G09G 2310/0224* (2013.01); *G09G 2310/0251* (2013.01); *G09G 2310/0262* (2013.01); *G09G 2310/0286* (2013.01); *G09G 2310/0289* (2013.01); *G09G 2310/0291* (2013.01); *G09G 2310/08* (2013.01)

(56) References Cited

U.S. PATENT DOCUMENTS

2006/0077168 A1* 4/2006 Fujita ..... G09G 3/3677 345/100
2006/0152459 A1* 7/2006 Shin ..... G09G 3/20 345/94
2008/0088561 A1* 4/2008 Kawabe ..... G09G 3/2029 345/92
2008/0186216 A1 8/2008 Choi
2010/0156966 A1* 6/2010 Kageyama ..... G09G 3/3233 345/691
2018/0197478 A1 7/2018 Wang

FOREIGN PATENT DOCUMENTS

CN 1855200 A 11/2006
CN 103295643 9/2013
CN 106097971 A 11/2016

OTHER PUBLICATIONS

Machine translation of CN103295643 by Patent Translate European Patent Office dated Nov. 7, 2018.
Translation of International Search Report downloaded from WIPO in related PCT/CN2017/070643 dated May 22, 2017.

* cited by examiner

AMOLED SCAN DRIVING CIRCUIT AND METHOD, LIQUID CRYSTAL DISPLAY PANEL AND DEVICE

CROSS-REFERENCE TO RELATED APPLICATIONS

The present application claims the priority of Chinese patent application CN 201610714844.1, entitled "AMOLED scan driving circuit and method, liquid crystal display panel and device," and filed on Aug. 24, 2016, the entirety of which is incorporated herein by reference.

FIELD OF THE INVENTION

The present disclosure relates to the field of liquid crystal display technology, and more particularly, to an AMOLED scan driving circuit and a method, a liquid crystal display panel and a device.

BACKGROUND OF THE INVENTION

An existing AMOLED scan driving circuit is structured as shown in FIG. 1, and its internal corresponding basic function module is as shown in FIG. 2, which can only be used for an AMOLED scan driving circuit requiring a single gate control signal.

When the AMOLED scan driving circuit requires two or more gate control signals, the existing scan driving compensation circuit cannot meet the need of outputting a plurality of gate control signals.

SUMMARY OF THE INVENTION

In order to solve the above problem, the present disclosure provides an AMOLED scan driving circuit and method, a liquid crystal display panel and a device for providing a plurality of scan driving signals.

According to an aspect of the present disclosure, an AMOLED scan driving circuit is provided, comprising:

shift register units; and logical units, wherein selectors are arranged between adjacent shift register units and between adjacent logical units, parts of the shift register units communicating with each other, and parts of the logical units communicating with each other via the selectors respectively, and different scan driving signals being output when the selectors are controlled by selection control signals, the shift register units are controlled by clock signals and start pulse signals, and the logical units are controlled by logic control signals.

According to one embodiment of the present disclosure, the shift register units are connected every other line via the selectors, and the logical units are connected every other line via the selectors, wherein the shift register units in odd-numbered lines are connected via the selectors in corresponding odd-numbered lines, and the logical units in odd-numbered lines are connected via the selectors in corresponding odd-numbered lines, and wherein the shift register units in even-numbered lines are connected via the selectors in corresponding even-numbered lines, and the logical units in even-numbered lines are connected via the selectors in corresponding even-numbered lines.

According to one embodiment of the present disclosure, an output end of the logical unit is connected with a level shifter and then with a digital buffer unit.

According to one embodiment of the present disclosure, the shift register units are connected every other line via the selectors, and the logical units are connected every other line via the selectors, wherein the shift register units in odd-numbered lines are connected via the selectors in corresponding odd-numbered lines, and the logical units in odd-numbered lines are connected via the selectors in corresponding odd-numbered lines; and the shift register units in even-numbered lines are connected via the selectors in corresponding even-numbered lines, and the logical units in even-numbered lines are connected via the selectors in corresponding even-numbered lines; and wherein each preceding shift register unit is connected to a succeeding shift register unit two lines spaced from the preceding shift register unit via the selector in a line corresponding to the preceding shift register unit, and each preceding logical unit is connected to a succeeding logical unit two lines spaced from the preceding logical unit via the selector in a line corresponding to the preceding logical unit.

According to one embodiment of the present disclosure, an output end of the logical unit is connected with a level shifter and then with a digital buffer unit.

According to another aspect of the present disclosure, an AMOLED scan driving method is also provided, such that selectors arranged between adjacent shift register units and between adjacent logical units and used for respectively communicating parts of the shift register units and parts of the logical units are controlled by selection control signals; shift register units are controlled by a combination of clock signals and start pulse signals; and logical units are controlled by logic signals, and different scan driving signals are thereby output.

According to one embodiment of the present disclosure, the clock signals include a first clock signal and a second clock signal; the start pulse signals include a first start pulse signal and a second start pulse signal; the logic signals include a first logic signal and a second logic signal, wherein when the selection control signals are in a first state, the first clock signal, the second clock signal, the first start pulse signal, and the first logic signal are valid, and scanning signals are sequentially output according to output line numbers; and wherein when the selection control signals are in a second state, the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1 and N+3, and N is a first output line number in the group.

According to one embodiment of the present disclosure, the clock signals include a first clock signal, a second clock signal, a third clock signals, a fourth clock signal, and a fifth clock signal; the start signals comprises a first start pulse signal, a second start pulse signal, and a third start pulse signal, and the logic signals comprise a first logic signal, a second logic signal, and a third logic signal, wherein when the selection control signals are in a first state, the first clock signal, the second clock signal, the first start pulse signal, and the first logic signal are valid, and scanning signals are sequentially output according to output line numbers;

wherein when the selection control signals are in a second state, the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1. and N+3, and N is a first output line number in the group; and wherein when the selection control signals are in a third state, the third clock signal, the fourth clock signal, the fifth clock signal, the first start pulse signal, the second start pulse signal, the third start pulse signal, the first logic signals the second logic signal, and the third logic signal are all valid, and the scanning signals are sequentially output with adjacent 6 output line numbers as one group, wherein an output sequence of the scanning signals in one group is N, N+3, N+1, N+4, N+2, and N+5, and N is a first output line number in the group.

According to still another aspect of the present disclosure, a liquid crystal display panel is also provided, comprising the AMOLED scan driving circuit described above and the AMOLED scan driving method using the same.

According to a further aspect of the present disclosure, a liquid crystal display device is also provided, comprising the liquid crystal display panel as described above.

Advantageous effects of the present disclosure are as follows.

In the present disclosure, the scan driving signals of different waveforms can be selected to be output respectively by selecting different combinations of the control signals, the clock signals, the start pulse signals, and the logic signals, so that the output waveforms of the scan driving circuits can be selected by external control signals, which is convenient for a double-drive design.

Other advantages, objectives, and features of the present disclosure will be set forth in the following description and, to some extent, will be apparent to those skilled in the art based on the study hereunder, or teachings can be obtained from the practice of the present disclosure. The objectives and advantages of the present disclosure will be achieved through the structure specifically pointed out in the description, claims, and the accompanying drawings.

BRIEF DESCRIPTION OF THE DRAWINGS

The drawings are provided for further understanding of the present disclosure, and constitute one part of the description, wherein the accompanying drawings illustrating embodiments of the present application are used in conjunction with the embodiments of the present application to explain the technical solution of the present application, but do not constitute a limitation to the technical solution of the present application.

DETAILED DESCRIPTION OF THE EMBODIMENTS

The embodiments of the present disclosure will be described in detail with reference to the accompanying drawings and examples, and how the technical solutions of the present disclosure are applied to solve the technical problems, and the realization process of the corresponding technical effects can be fully understood and implemented. The various features of the embodiments and examples of the present application may be combined with each other without conflict, and the resulting technical solutions are within the scope of the present disclosure.

Figure 1:
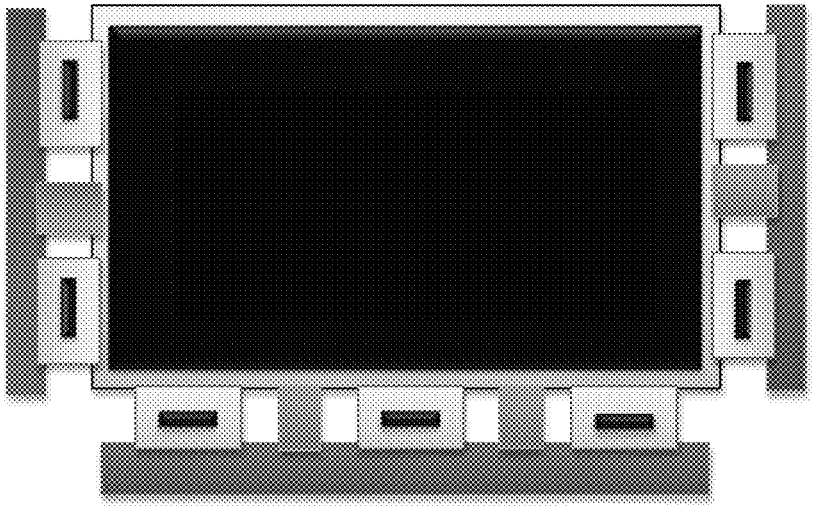
FIG. 1 is a diagram illustrating a structure of an AMOLED scan driving circuit.
Figure 2:
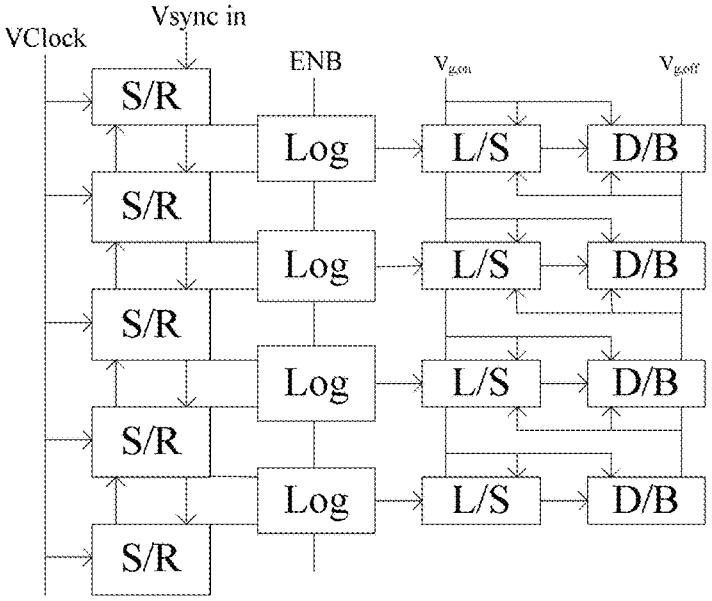
FIG. 2 is a diagram illustrating an internal basic function module corresponding to FIG. 1.
Figure 3:
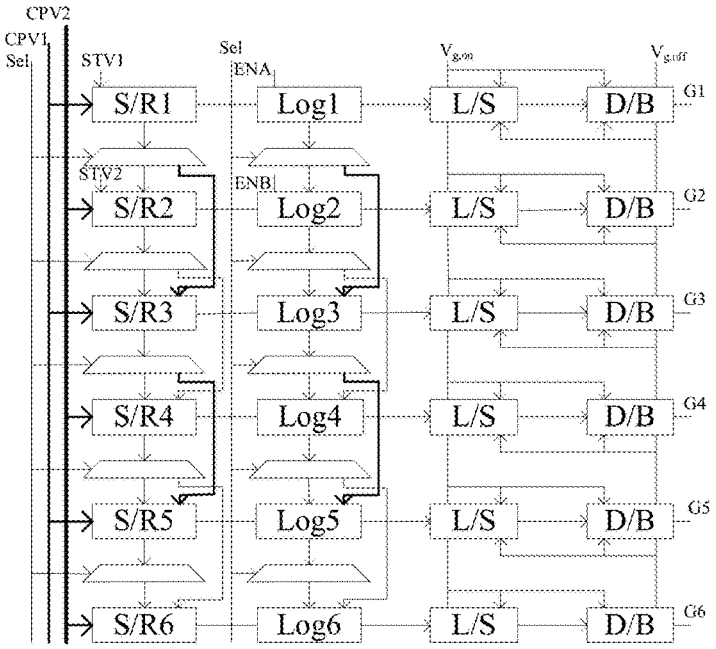
FIG. 3 is a diagram illustrating an internal basic functional module according to an embodiment of the present disclosure.
Figure 7:
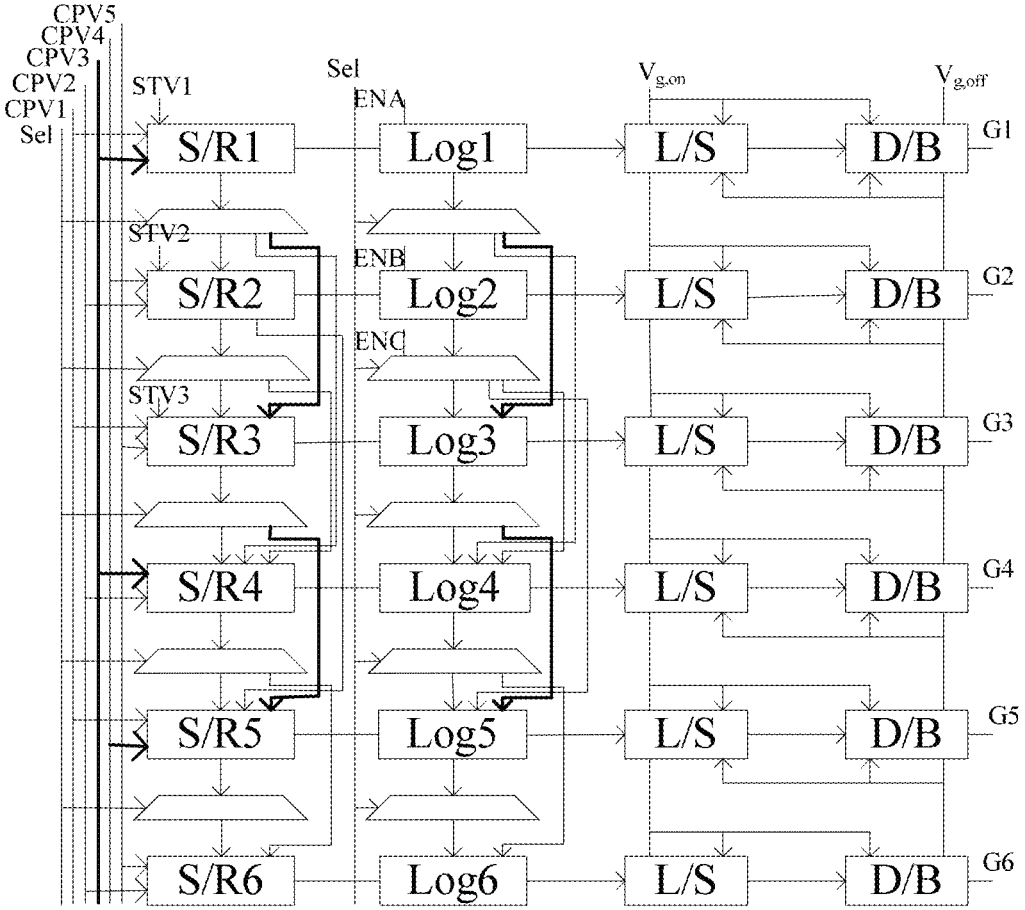
FIG. 7 is a diagram illustrating an internal basic functional module according to another embodiment of the present disclosure.

In order to solve the problem that an AMOLED scan driving circuit needs two or more gate control signals, while the existing scan driving circuit cannot meet the requirements, the present disclosure provides an AMOLED scan driving circuit. As shown in FIGS. 3 and 7, a diagram illustrating a basic functional module in the AMOLED scan driving circuit according to an embodiment of the present disclosure is provided. The present disclosure will be described in detail with reference to FIGS. 3 and 7 hereinafter.

The AMOLED scan driving circuit includes shift register units and logical units, wherein selectors are arranged between adjacent shift register units and between adjacent logical units. Parts of the shift register units communicate with each other, and parts of the logical units communicate with each other via the selectors respectively. Different scan driving signals are output when the selectors are controlled by selection control signals; the shift register units are controlled by clock signals and start pulse signals; and the logical units are controlled by logic control signals.

In the present disclosure, scan driving signals of different waveforms can be selected to be output respectively by selecting different combinations of the control signals, the clock signals and the start pulse signals, and the logic signals, so that the output waveforms of the scan driving circuits can be selected by external control signals, which is convenient for a double-drive design.

FIG. 3 is a diagram illustrating a structure of an AMOLED scan driving circuit according to one embodiment of the present disclosure. As shown in FIG. 3, a plurality of shift register units S/R are arranged in parallel, and the logical units Log are connected to the shift register units S/R in one-to-one correspondence. Selectors are provided between the adjacent shift register units and the adjacent logical units, and controlled by the selection control signals Sel.

In order to realize the output of the scan driving signals, an output end of each of the logical units is connected with a level shifter L/S and then with a digital buffer unit D/B. Level shifting is performed by the level shifter under control of an on voltage $V_{g,on}$, and is stopped under control of an off voltage $V_{g,off}$. The digital buffer unit caches and outputs the scan driving signals under control of the on voltage $V_{g,on}$, and stops buffering, and then outputs the scan driving signals under control of the off voltage $V_{g,off}$.

As shown in FIG. 3, the shift register units are connected every other line via the selectors, and the logical units are connected every other line via the selectors, wherein the shift register units in odd-numbered lines are connected via the selectors in corresponding odd-numbered lines, and the logical units in odd-numbered lines are connected via the selectors in corresponding odd-numbered lines; and the shift register units in even-numbered lines are connected via the selectors in corresponding even-numbered lines, and logical units in even-numbered lines are connected via the selectors in corresponding even-numbered lines. The clock signals here include a first clock signal CPV1 and a second clock signal CPV2; the start pulse signals include a first start pulse signal STV1 and a second start pulse signal STV2; and the logic signals include a first logic signal ENA and a second logic signal ENB. Scan driving signals of different waveforms can be output by a combination of the first clock signal and the second clock signal, the first start pulse signal and the second start pulse signal, and the first logic signal and the second logic signal.

The AMOLED scan driving circuit as shown in FIG. 3 can output scanning signals of two kinds of waveforms. Specifically, in the first case, when the selection control signals Sel are in a first state, the first clock signal, the second clock signal, the first start pulse signal, and the first logic signal are valid, and the scanning signals are sequentially output according to output line numbers. That is to say, the scan driving circuit can be controlled to output the scanning signals in an order of G1, G2, G3, G4, G5, G6 . . . .

At this time, the selector between the adjacent shift register units connects the adjacent shift register units, and the selector between the adjacent logical units connects the adjacent logical units. The scan driving circuit is controlled to output the scanning signals in an order of G1, G2, G3, G4, G5, G6 . . . by the shift register units under the effect of the first clock signal, the second clock signal, and the first start pulse signal, and by the logic units under the effect of the first logic signal.

In the second case, when the selection control signals Sel are in a second state, the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1, and N+3, and N is a first output line number in the group. That is to say, the scan driving circuit can be controlled to output the scanning signals in an order of G1, G3, G2, G4, G5, G7, G6, G8 . . . .

With the effect of the selector, the odd-numbered line shift register units communicate with each other via a corresponding odd-numbered line selector, and the even-numbered line shift register units communicate with each other via a corresponding even-numbered line selector, while adjacent odd-numbered line shift register unit and even-numbered line shift register unit do not communicate with each other. The scan driving circuit is controlled to output the scanning signals in an order of G1, G3, G2, G4, G5, G7, G6, G8 . . . by the odd-numbered line shift register unit under the effect of the first clock signal and the first start pulse signal, by the even-numbered line shift register unit under the effect of the second clock signal and the second start pulse signal, by the odd-numbered logical unit under the effect of the first logic signal, and by the even-numbered line logical unit under the effect of the second logic signal.

Specifically, for example, when the selection control signals Sel are in the second state, the first clock signal and the first start pulse signal are turned on, and S\R1 is turned on to output the scanning signal G1. At the same time, S\R1 outputs a similar start signal to S\R3 via the selector, and S\R3 is turned on to output the scanning signal G3. At this time, a delay similar to the start signal is output by S/R3, and the first clock signal is closed, while the second clock signal and the second start pulse signal are turned on, such that the selection control signals Sel are kept in the second state. S\R2 is turned on to output the scanning signal G2. At the same time, S\R2 outputs a similar start signal to S\R4 via the selector, and S\R4 is turned on to output the scanning signal G4. Next, the first clock signal and the first start pulse signal are turned on, and the selection control signals Sel are kept in the second state, such that the scanning signals G5 and G7 are output, and so on.

Of course, the scanning signals can be output in any order when an order in which the shift register units and the logical units are connected via the selectors is changed, and corresponding clock signals, start pulse signals, and logic signals are modulated. As for the output waveforms of the scanning signals, waveforms of the first clock signal and the second clock signal, the first start pulse signal and the second start pulse signal, and the first logic signal and the second logic signal can be controlled by a timing control circuit TCON to provide scanning control signals needed by a compensation circuit.

Figure 4:
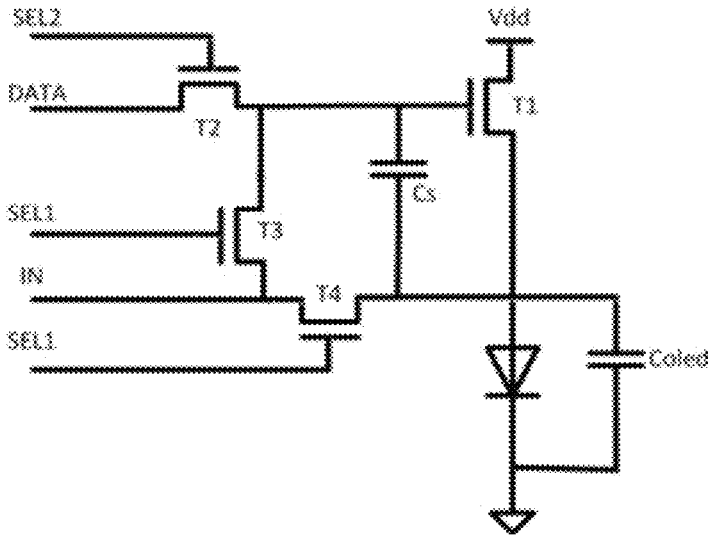
Fig. 4 (Prior Art)
FIG. 4 is a diagram illustrating a 4T1C internal compensation circuit in the prior art.
Figure 5:
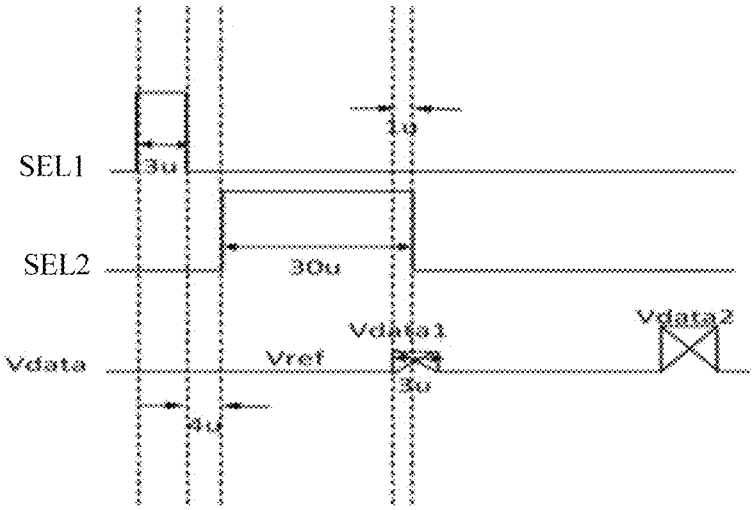
FIG. 5 is a timing diagram corresponding to FIG. 4.
Figure 6:
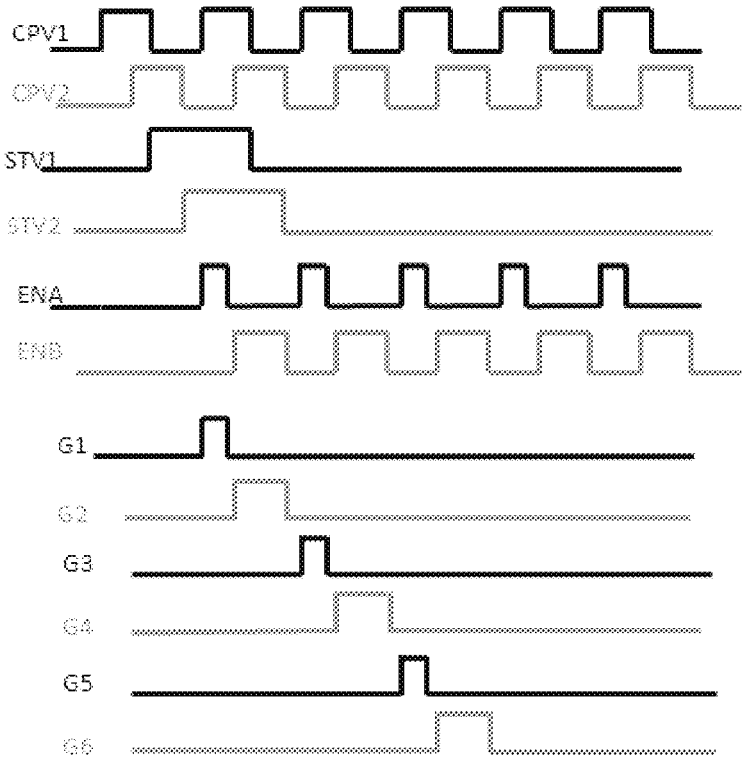
FIG. 6 is a signals timing diagram corresponding to FIG. 3.

FIG. 4 is a diagram showing principles for an existing 4T1C internal compensation circuit. The scan driving signals shown in FIG. 3 are input via a DATA end of FIG. 4 and output to an organic light emitting diode OLED under the effect of control signals SEL1, SEL2, and an input signal IN, and a driving signal Vdd. Timing of the control signals SEL1, SEL2, and input data at the DATA end is shown in FIG. 5, and timing of the control signals and output signals of FIG. 3 which generates the input data at the DATA end is shown in FIG. 6.

FIG. 7 is a diagram showing an internal basic function module of an AMOLED scan driving circuit according to another embodiment of the present disclosure. As shown in FIG. 7, a plurality of shift register units S/R are arranged in parallel, and the logical units are connected to the shift register units in one-to-one correspondence. Selectors are provided between adjacent shift register units and adjacent logical units. Parts of the shift register units communicate with each other, and parts of the logical units communicate with each other via the selectors, respectively. The selectors are controlled by the selection control signals Sel.

In order to realize the output of the scan driving signals, the output end corresponding to each of the logical units is connected with a level shifter L/S and then with a digital buffer unit D/B. These two units output scan driving signals under control of the on voltage $V_{g,on}$, and stops outputting the scan driving signals under control of the off voltage $V_{g,off}$.

As shown in FIG. 7, the shift register units are connected every other line via the selectors, and the logical units are connected every other line via the selectors, wherein the shift register units in odd-numbered lines are connected via the selectors in corresponding odd-numbered lines, and the logical units in odd-numbered lines are connected via the selectors in corresponding odd-numbered lines; the shift register units in even-numbered lines are connected via the selectors in corresponding even-numbered lines, and the logical units in even-numbered lines are connected via the selectors in corresponding even-numbered lines. And each preceding shift register unit is connected to a succeeding shift register unit two lines spaced from the preceding shift register unit via the selector in a line corresponding to the preceding upper shift register unit, and each preceding logical unit is connected to a succeeding logical unit two lines spaced from the preceding logical unit via the selector in a line corresponding to the preceding logical unit. That is to say, the first line of shift register unit S/R1 is connected to the fourth line of shift register unit S/R4 via the selector corresponding to the first line of shift register unit S/R1, and the second line of logical unit is connected to the fifth line of logical unit via the selector corresponding to the second line of logical unit.

As shown in FIG. 7, the clock signals include five clock signals including a first clock signal CPV1, a second clock signal CPV2, a third clock signal CPV3, a fourth clock signal CPV4, and a fifth clock signal CPV5. The start signals include a first start pulse signal STV1, a second start pulse signal STV2, and a third start pulse signal STV3. The logic signals include a first logic signal ENA, a second logic signal ENB, and a third logic signals ENC.

The AMOLED scan driving circuit as shown in FIG. 7 can output scanning signals of three kinds of waveforms. Specifically, when the selection control signals are in a first state (for example, Sel=00), the first clock signal, the second clock signal, the first start pulse signal, and the first logic signal are valid, and scanning signals are sequentially output according to output line numbers. That is to say, the scan driving circuit can be controlled to output the scanning signals in an order of G1, G2, G3, G4, G5, G6 . . . . At this time, the selector between adjacent shift register units enables communication between the adjacent shift register units, and the selector between adjacent logical units enables communication between the adjacent logical units. The scan driving circuit is controlled to output the scanning signals in an order of G1, G2, G3, G4, G5, G6 . . . by each shift register unit under the effect of the first clock signal, the second clock signal, and the first start pulse signal, and by the logic unit under the effect of the first logic signal.

In a second case, when the selection control signals Sel are in a second state (for example, Sel=01), the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1, and N+3, and N is a first output line number in the group. That is to say, the scanning drive circuit can be controlled to output the scanning signals in an order of G1, G3, G2, G4, G5, G7 . . . . With the effect of the selector, the odd-numbered line shift register units communicate with each other via a corresponding odd-numbered line selector, and the even-numbered line shift register units communicate with each other via a corresponding even-numbered line selector, while the adjacent odd-numbered line shift register unit and even-numbered line shift register unit do not communicate with each other. The scan driving circuit is controlled to output the scanning signals in an order of G1, G3, G2, G4, G5, G7, . . . by the odd-numbered line shift register unit under the effect of the first clock signal and the first start pulse signal, by the even-numbered line shift register unit under the effect of the second clock signal and the second start pulse signal, by the odd-numbered logical unit under the effect of the first logic signal, and by the even-numbered line logical unit under the effect of the second logic signal. A specific signal matching procedure is the same as that shown in FIG. 3, which will not be described in detail herein.

In a third case, when the selection control signals are in a third state (for example, Sel=10), and the third clock signal, the fourth clock signal, and the fifth clock signal, the first pulse start signal, the second start pulse signal, the third start pulse signal, the first logic signal, the second logic signal, and the third logic signal are all valid, the scanning signals are output with adjacent six output line numbers as one group, wherein a group of internal scanning signals are output in an order of N, N+3, N+1, N+4, N+2, and N+5, N being the first output line number in the group. That is to say, the scanning drive circuit can be controlled to output the scanning signals in an order of G1, G4, G2, G5, G3, G6 . . . .

Specifically, G1 and G4 output signals when the selection control signals Sel are in the third state, and the third clock signal, the first start pulse signal, and the first logic signal interact with each other; G2 and G5 output signals when the fourth clock signal, the second start pulse signal, and the second logic signal interact with each other; G3 and G6 output signals when the fifth clock signal, the third start pulse signal, and the third logic signal interact with each other, and so on. In this way, the scanning signals can be output in an order of G1, G4, G2, G5, G3, G6 . . . .

Of course, the scanning signals can be output in any order when the order in which the shift register unit and the logical unit are connected via the selectors is changed, and corresponding clock signals, start pulse signals, and logic signals are modulated. As for the output waveforms of the scanning signals, various signals can be controlled by a timing control circuit TCON to provide scanning control signals needed by a compensation circuit.

According to another aspect of the present disclosure, an AMOLED scan driving method is also provided. According to the method, selectors arranged between adjacent shift register units and between adjacent logical units and used for respectively communicating parts of the shift register units and parts of the logical units are controlled by selection control signals. The shift register units are controlled by a combination of the clock signals and the start pulse signals, and the logical units are controlled by the logic signals, so that different scan driving signals are output.

Further, as for the AMOLED scan driving circuit corresponding to FIG. 3, the clock signals include a first clock signal and a second clock signal; the start pulse signals includes a first start pulse signal and a second start pulse signal; and the logic signals include a first logic signal and a second logic signal.

When the selection control signals are in the first state, the first clock signal, the second clock signal, the first start pulse signal, and the first logic signal are valid, and scanning signals are sequentially output according to output line numbers. That is to say, the scan driving circuit can be controlled to output the scanning signals in an order of G1, G2, G3, G4, G5, G6, G7, G8 . . . .

When the selection control signals are in the second state, the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1, and N+3, and N is a first output line number in the group. That is to say, the scanning signals are output in an order of G1, G3, G2, G4, G5, G7, G6, G8 . . . .

As for the AMOLED scan driving circuit corresponding to FIG. 7, the clock signals include the first clock signal, the second clock signal, the third clock signal, the fourth clock signal, and the fifth clock signal; the start signals include the first start pulse signal, the second start pulse signal, and the third start pulse signal; and the logic signals include the first logic signal, the second logic signal, and the third logic signal.

When the selection control signals are in the first state, the first clock signal, the second clock signal, the first start pulse signal, and the first logic signal are valid, and scanning signals are sequentially output according to output line numbers. That is to say, the scanning signals can be output in an order of G1, G2, G3, G4, G5, G6 . . . .

When the selection control signals are in the second state, the first clock signal, the second clock signal, the first start pulse signal, the second start pulse signal, the first logic signal, and the second logic signals\ are all valid, and the scanning signals are sequentially output with adjacent 4 output line numbers as one group, wherein an output sequence of the scanning signals in one group is N, N+2, N+1, and N+3, and N is a first output line number in the group. That is to say, the scanning signals are output in an order of G1, G3, G2, G4, G5, G7 . . . .

When the selection control signals are in the third state, the third clock signal, the fourth clock signal, the fifth clock signal, the first pulse start signal, the second start pulse signal, the third start pulse signal, the first logic signal, the second logic signal, and the third logic signal are all valid, and the scanning signals are output with adjacent six output line numbers as one group, wherein a group of internal scanning signals are output in an order of N, N+3, N+1, N+4, N+2, and N+5, N being a first output line number in the group. That is to say, the scanning signals are output in an order of G1, G4, G2, G5, G3, G6 . . . .

According to another aspect of the present disclosure, a liquid crystal display panel is also provided, comprising the AMOLED scan driving circuit described above and the AMOLED scan driving method using the same.

According to another aspect of the present disclosure, a liquid crystal display device is also provided, comprising the liquid crystal display panel as described above.

Although the embodiments of the present disclosure are disclosed above, they are merely for the understanding of the present disclosure, but are not intended to be limitation of the present disclosure. It will be apparent to those skilled in the art to which the present disclosure pertains that any modifications and variations may be made in the form and details of the present disclosure without departing from the spirit and scope of the present disclosure, but the scope of the present disclosure is subject to the scope of the appended claims.

The invention claimed is:

1. An AMOLED scan driving circuit, comprising:

shift register units; and logical units, wherein selectors are arranged between adjacent shift register units and between adjacent logical units, parts of the shift register units communicating with each other, and parts of the logical units communicating with each other via the selectors respectively, and different scan driving signals being output when the selectors are controlled by selection control signals, the shift register units are controlled by clock signals and start pulse signals, and the logical units are controlled by logic control signals, wherein the shift register units are connected every other line via the selectors, and the logical units are connected every other line via the selectors; and the shift register units are connected sequentially via the selectors and the logic units are connected sequentially via the selectors, wherein the selectors that are arranged between adjacent shift register units are such that each of the selectors connects a previous one of two adjacent ones of the shift register units to a next one of the two adjacent ones of the shift register units and a further one of the shift register units that is next to the next one of the two adjacent ones of the shift register units, and the selectors that are arranged between adjacent logical units are such that each of the selectors connects a previous one of two adjacent ones of the logical units to a next one of the two adjacent ones of the logical units and a further one of the logical units that is next to the next one of the two adjacent ones of the logical units, wherein the shift register units in odd-numbered lines are connected via the selectors in corresponding odd-numbered lines, and the logical units in odd-numbered lines are connected via the selectors in corresponding odd-numbered lines, such that in a first state, the selectors in corresponding odd-numbered lines selectively form connections between the shift register units in odd-number lines and connections between the logic units in odd-number lines only and in a second state, the selectors in the corresponding odd-numbered lines selectively form connections between the shift register units in the odd-numbered lines and the shift register units in even-numbered lines that are immediately next to the shift register units in the odd-numbered lines and also form connections between the logical units in the corresponding odd-numbered lines and the logical units in even-numbered lines that are immediately next to the logical units of the odd-numbered lines, and wherein the shift register units in even-numbered lines are connected via the selectors in corresponding even-numbered lines, and the logical units in even-numbered lines are connected via the selectors in corresponding even-numbered lines, such that in a third state, the selectors in corresponding even-numbered lines selectively form connections between the shift register units in even-number lines and connections between the logic units in even-number lines only and in a fourth state, the selectors in the corresponding even-numbered lines selectively form connections between the shift register units in the even-numbered lines and the shift register units in odd-numbered lines that are immediately next to the shift register units in the even-numbered lines and also form connections between the logical units in the corresponding even-numbered lines and the logical units in odd-numbered lines that are immediately next to the logical units of the even-numbered lines.

2. The circuit according to claim 1, wherein an output end of the logical unit is connected with a level shifter and then with a digital buffer unit.

3. The circuit according to claim 1, wherein each preceding shift register unit is connected to a succeeding shift register unit two lines spaced from the preceding shift register unit via the selector in a line corresponding to the preceding shift register unit, and each preceding logical unit is connected to a succeeding logical unit two lines spaced from the preceding logical unit via the selector in a line corresponding to the preceding logical unit.

4. The circuit according to claim 3, wherein an output end of the logical unit is connected with a level shifter and then with a digital buffer unit.

5. An AMOLED scan driving method for driving an AMOLED scan driving circuit, the circuit comprising:

shift register units; and logical units, wherein selectors are arranged between adjacent shift register units and between adjacent logical units, parts of the shift register units communicating with each other and parts of the logical units communicating with each other through the selectors respectively, and different scan driving signals being output when the selectors are controlled by selection control signals, the shift register units are controlled by clock signals and start pulse signals, and the logical units are controlled by logic control signals, wherein the shift register units are connected every other line via the selectors, and the logical units are connected every other line via the selectors; and the shift register units are connected sequentially via the selectors and the logic units are connected sequentially via the selectors, wherein the selectors that are arranged between adjacent shift register units are such that each of the selectors connects a previous one of two adjacent ones of the shift register units to a next one of the two adjacent ones of the shift register units and a further one of the shift register units that is next to the next one of the two adjacent ones of the shift register units, and the selectors that are arranged between adjacent logical units are such that each of the selectors connects a previous one of two adjacent ones of the logical units to a next one of the two adjacent ones of the logical units and a further one of the logical units that is next to the next one of the two adjacent ones of the logical units, wherein the shift register units in odd-numbered lines are connected via the selectors in corresponding odd-numbered lines, and the logical units in odd-numbered lines are connected via the selectors in corresponding odd-numbered lines, such that in a first state, the selectors in corresponding odd-numbered lines selectively form connections between the shift register units in odd-number lines and connections between the logic units in odd-number lines only and in a second state, the selectors in the corresponding odd-numbered lines selectively form connections between the shift register units in the odd-numbered lines and the shift register units in even-numbered lines that are immediately next to the shift register units in the odd-numbered lines and also form connections between the logical units in the corresponding odd-numbered lines and the logical units in even-numbered lines that are immediately next to the logical units of the odd-numbered lines, and wherein the shift register units in even-numbered lines are connected via the selectors in corresponding even-numbered lines, and the logical units in even-numbered lines are connected via the selectors in corresponding even-numbered lines, such that in a third state, the selectors in corresponding even-numbered lines selectively form connections between the shift register units in even-number lines and connections between the logic units in even-number lines only and in a fourth state, the selectors in the corresponding even-numbered lines selectively form connections between the shift register units in the even-numbered lines and the shift register units in odd-numbered lines that are immediately next to the shift register units in the even-numbered lines and also form connections between the logical units in the corresponding even-numbered lines and the logical units in odd-numbered lines that are immediately next to the logical units of the even-numbered lines, and the method comprising: controlling, by the selection control signals, the selectors which are arranged between the adjacent shift register units and between the adjacent logical units and used for respectively communicating parts of the shift register units and parts of the logical units, and controlling, by combination of the clock signals and the start pulse signals, the shift register units, and by the logic signals, the logical units, so that different scan driving signals are output.

6. The method according to claim 5, wherein the method is used for driving an AMOLED scan driving circuit, the method being such that:

the clock signals include a first clock signal and a second clock signal; the start pulse signals include a first start pulse signal and a second start pulse signal; and the logic signals include a first logic signal and a second logic signal, when the selection control signals are in a first state, the first clock signal, the second clock signal, the first start pulse signal, and the first logic signals are valid, and scanning signals are sequentially output according to output line numbers, and when the selection control signals are in a second state, the first clock signal, the second clock signals, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1, and N+3, and N is a first output line number in the group.

7. The method according to claim 5, wherein the method is used for driving an AMOLED scan driving circuit, the circuit being such that:

each preceding shift register unit is connected to a succeeding shift register unit two lines spaced from the preceding shift register through the selector in a line corresponding to the preceding shift register unit, and each preceding logical unit is connected to a succeeding logical unit two lines spaced from the preceding logical unit through the selector in a line corresponding to the preceding logical unit, and the method being such that:

the clock signals include a first clock signal, a second clock signal, a third clock signal, a fourth clock signal, and a fifth clock signal; the start pulse signals include a first start pulse signal, a second start pulse signal, and a third start pulse signal; the logic signals include a first logic signal, a second logic signal, and a third logic signal, when the selection control signals are in a first state, the first clock signal, the second clock signal, the first start pulse signal, and the first logic signal are valid, and scanning signals are sequentially output according to output line numbers, when the selection control signals are in a second state, the first clock signal, the second clock signal, the first start pulse signal, the second start pulse signal, the first logic signal, and the second logic signal are all valid, and the scanning signals are sequentially output with adjacent 4 output line numbers as one group, wherein an output sequence of the scanning signals in one group is N, N+2, N+1, and N+3, and N is a first output line number in the group, and when the selection control signals are in a third state, the third clock signal, the fourth clock signal, the fifth clock signal, the first start pulse signal, the second start pulse signal, the third start pulse signal, the first logic signals the second logic signal, and the third logic signal are all valid, and the scanning signals are sequentially output with adjacent 6 output line numbers as one group, wherein an output sequence of the scanning signals in one group is N, N+3, N+1, N+4, N+2, and N+5, and N is a first output line number in the group.

8. A liquid crystal display panel, comprising an AMOLED scan driving circuit, the circuit comprising:

shift register units; and logical units, wherein selectors are arranged between adjacent shift register units and between adjacent logical units, parts of the shift register units communicating with each other, and parts of the logical units communicating with each other through the selectors respectively, and different scan driving signals being output when the selectors are controlled by selection control signals; the shift register units are controlled by clock signals and start pulse signals; and the logical units are controlled by logic control signals, wherein the shift register units are connected every other line via the selectors, and the logical units are connected every other line via the selectors; and the shift register units are connected sequentially via the selectors and the logic units are connected sequentially via the selectors, wherein the selectors that are arranged between adjacent shift register units are such that each of the selectors connects a previous one of two adjacent ones of the shift register units to a next one of the two adjacent ones of the shift register units and a further one of the shift register units that is next to the next one of the two adjacent ones of the shift register units, and the selectors that are arranged between adjacent logical units are such that each of the selectors connects a previous one of two adjacent ones of the logical units to a next one of the two adjacent ones of the logical units and a further one of the logical units that is next to the next one of the two adjacent ones of the logical units, wherein the shift register units in odd-numbered lines are connected via the selectors in corresponding odd-numbered lines, and the logical units in odd-numbered lines are connected via the selectors in corresponding odd-numbered lines, such that in a first state, the selectors in corresponding odd-numbered lines selectively form connections between the shift register units in odd-number lines and connections between the logic units in odd-number lines only and in a second state, the selectors in the corresponding odd-numbered lines selectively form connections between the shift register units in the odd-numbered lines and the shift register units in even-numbered lines that are immediately next to the shift register units in the odd-numbered lines and also form connections between the logical units in the corresponding odd-numbered lines and the logical units in even-numbered lines that are immediately next to the logical units of the odd-numbered lines, and wherein the shift register units in even-numbered lines are connected via the selectors in corresponding even-numbered lines, and the logical units in even-numbered lines are connected via the selectors in corresponding even-numbered lines, such that in a third state, the selectors in corresponding even-numbered lines selectively form connections between the shift register units in even-number lines and connections between the logic units in even-number lines only and in a fourth state, the selectors in the corresponding even-numbered lines selectively form connections between the shift register units in the even-numbered lines and the shift register units in odd-numbered lines that are immediately next to the shift register units in the even-numbered lines and also form connections between the logical units in the corresponding even-numbered lines and the logical units in odd-numbered lines that are immediately next to the logical units of the even-numbered lines.

9. The panel according to claim 8, wherein each preceding shift register unit is connected to a succeeding shift register unit two lines spaced from the preceding shift register unit through the selector in a line corresponding to the preceding shift register unit, and each preceding logical unit is connected to a succeeding logical unit two lines spaced from the preceding logical unit through the selector in a line corresponding to the preceding logical unit.

10. The panel according to claim 8, wherein the selectors arranged between adjacent shift register units and between adjacent logical units and used for respectively communicating parts of the shift register units and parts of the logical units are controlled by selection control signals, and wherein the shift register units are controlled by a combination of the clock signals and the start pulse signals, and the logical units are controlled by the logic signals, so that different scan driving signals are output.

11. The panel according to claim 10, wherein the clock signals include a first clock signal and a second clock signal; the start pulse signals include a first start pulse signal and a second start pulse signal; and the logic signals include a first logic signal and a second logic signal, wherein when the selection control signals are in a first state, the first clock signal, the second clock signal, the first start pulse signal, and the first logic signal are valid, and scanning signals are sequentially output according to output line numbers, and wherein when the selection control signals are in a second state, all the first clock signal, the second clock signal, the first start pulse signal, the second start pulse signal, the first logic signal, and the second logic signal are valid, and the scanning signals are sequentially output with adjacent 4 output line numbers as one group, wherein an output sequence of the scanning signals in one group is N, N+2, N+1, and N+3, and N is a first output line number in the group.

12. The panel according to claim 10, wherein the clock signals include a first clock signal, a second clock signal, a third clock signal, a fourth clock signal, and a fifth clock signal; the start pulse signals include a first start pulse signal, a second start pulse signal, and a third start pulse signal; and the logic signals include a first logic signal, a second logic signal, and a third logic signal, wherein when the selection control signals are in a first state, the first clock signal, the second clock signal, the first start pulse signal, and the first logic signal are valid, and scanning signals are sequentially output according to output line numbers, wherein when the selection control signals are in a second state, all the first clock signal, the second clock signal, the first start pulse signal, the second start pulse signal, the first logic signal, and the second logic signal are valid, and the scanning signals are sequentially output with adjacent 4 output line numbers as one group, wherein an output sequence of the scanning signals in one group is N, N+2, N+1, and N+3, and N is a first output line number in the group, and wherein when the selection control signals are in a third state, the third clock signal, the fourth clock signal, the fifth clock signal, the first start pulse signal, the second start pulse signal, the third start pulse signal, the first logic signal, the second logic signal, and the third logic signal are all valid, and the scanning signals are sequentially output with adjacent 6 output line numbers as one group, wherein an output sequence of the scanning signals in one group is N, N+3, N+1, N+4, N+2, and N+5, and N is a first output line number in the group.

13. A liquid crystal display device, comprising a liquid crystal display panel, the liquid display panel comprising an AMOLED scan driving circuit, the circuit comprising:

shift register units; and logical units, wherein selectors are arranged between adjacent shift register units and between adjacent logical units, parts of the shift register units communicating with each other, and parts of the logical units communicating with each other through the selectors respectively, and different scan driving signals being output when the selectors are controlled by selection control signals; the shift register units are controlled by clock signals and start pulse signals; and the logical units are controlled by logic control signals, wherein the shift register units are connected every other line via the selectors, and the logical units are connected every other line via the selectors; and the shift register units are connected sequentially via the selectors and the logic units are connected sequentially via the selectors, wherein the selectors that are arranged between adjacent shift register units are such that each of the selectors connects a previous one of two adjacent ones of the shift register units to a next one of the two adjacent ones of the shift register units and a further one of the shift register units that is next to the next one of the two adjacent ones of the shift register units, and the selectors that are arranged between adjacent logical units are such that each of the selectors connects a previous one of two adjacent ones of the logical units to a next one of the two adjacent ones of the logical units and a further one of the logical units that is next to the next one of the two adjacent ones of the logical units, wherein the shift register units in odd-numbered lines are connected via the selectors in corresponding odd-numbered lines, and the logical units in odd-numbered lines are connected via the selectors in corresponding odd-numbered lines, such that in a first state, the selectors in corresponding odd-numbered lines selectively form connections between the shift register units in odd-number lines and connections between the logic units in odd-number lines only and in a second state, the selectors in the corresponding odd-numbered lines selectively form connections between the shift register units in the odd-numbered lines and the shift register units in even-numbered lines that are immediately next to the shift register units in the odd-numbered lines and also form connections between the logical units in the corresponding odd-numbered lines and the logical units in even-numbered lines that are immediately next to the logical units of the odd-numbered lines, and wherein the shift register units in even-numbered lines are connected via the selectors in corresponding even-numbered lines, and the logical units in even-numbered lines are connected via the selectors in corresponding even-numbered lines, such that in a third state, the selectors in corresponding even-numbered lines selectively form connections between the shift register units in even-number lines and connections between the logic units in even-number lines only and in a fourth state, the selectors in the corresponding even-numbered lines selectively form connections between the shift register units in the even-numbered lines and the shift register units in odd-numbered lines that are immediately next to the shift register units in the even-numbered lines and also form connections between the logical units in the corresponding even-numbered lines and the logical units in odd-numbered lines that are immediately next to the logical units of the even-numbered lines.

14. The device according to claim 13, wherein each preceding shift register unit is connected to a succeeding shift register unit two lines spaced from the preceding shift register unit through the selector in a line corresponding to the preceding shift register unit, and each preceding logical unit is connected to a succeeding logical unit two lines spaced from the preceding logical unit through the selector in a line corresponding to the preceding logical unit.

15. The device according to claim 13, wherein the selectors arranged between adjacent shift register units and between adjacent logical units and used for respectively communicating parts of the shift register units and parts of the logical units are controlled by selection control signals, and wherein the shift register units are controlled by a combination of the clock signals and the start pulse signals, and the logical units are controlled by the logic signals, so that different scan driving signals are output.

16. The device according to claim 15, wherein the clock signals include a first clock signal and a second clock signal; the start pulse signals include a first start pulse signal and a second start pulse signal; and the logic signals include a first logic signal and a second logic signal, wherein when the selection control signals are in a first state, the first clock signal, the second clock signal, the first start pulse signal, and the first logic signal are valid, and scanning signals are sequentially output according to output line numbers, and wherein when the selection control signals are in a second state, all the first clock signal, the second clock signal, the first start pulse signal, the second start pulse signal, the first logic signal, and the second logic signal are valid, and the scanning signals are sequentially output with adjacent 4 output line numbers as one group, wherein an output sequence of the scanning signals in one group is N, N+2, N+1, and N+3, and N is a first output line number in the group.

17. The device according to claim 15, wherein the clock signals include a first clock signal, a second clock signal, a third clock signal, a fourth clock signal, and a fifth clock signal; the start pulse signals include a first start pulse signal, a second start pulse signal, and a third start pulse signal; and the logic signals include a first logic signal, a second logic signal, and a third logic signal, wherein when the selection control signals are in a first state, the first clock signal, the second clock signal, the first start pulse signal, and the first logic signal are valid, and scanning signals are sequentially output according to output line numbers, wherein when the selection control signals are in a second state, all the first clock signal, the second clock signal, the first start pulse signal, the second start pulse signal, the first logic signal, and the second logic signal are valid, and the scanning signals are sequentially output with adjacent 4 output line numbers as one group, wherein an output sequence of the scanning signals in one group is N, N+2, N+1, and N+3, and N is a first output line number in the group; and wherein when the selection control signals are in a third state, the third clock signal, the fourth clock signal, the fifth clock signal, the first start pulse signal, the second start pulse signal, the third start pulse signal, the first logic signal, the second logic signal, and the third logic signal are all valid, and the scanning signals are sequentially output with adjacent 6 output line numbers as one group, wherein an output sequence of the scanning signals in one group is N, N+3, N+1, N+4, N+2, and N+5, and N is a first output line number in the group.

* * * * *